US006295958B2

(12) United States Patent
Pierik

(10) Patent No.: US 6,295,958 B2
(45) Date of Patent: Oct. 2, 2001

(54) LINKLESS VARIABLE VALVE ACTUATION MECHANISM

(75) Inventor: Ronald J. Pierik, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/766,078

(22) Filed: Jan. 19, 2001

Related U.S. Application Data

(60) Provisional application No. 60/176,977, filed on Jan. 19, 2000.

(51) Int. Cl.[7] ..... F01L 13/00

(52) U.S. Cl. ..... 123/90.16; 123/90.17

(58) Field of Search ..... 123/90.15, 90.16, 123/90.17, 90.22, 90.31, 90.6

(56) References Cited

U.S. PATENT DOCUMENTS 5,937,809 8/1999 Pierik et al. ..... 123/90.16
5,996,540 * 12/1999 Hara ..... 123/90.16
6,019,076 2/2000 Pierik et al. ..... 123/90.16
6,041,746 * 3/2000 Takemura et al. ..... 123/90.16
6,135,076 * 10/2000 Martinez ..... 123/90.16
6,135,078 10/2000 Doi et al. ..... 123/90.18
6,186,101 * 2/2001 Kreuter ..... 123/90.15

* cited by examiner

*Primary Examiner*—Weilun Lo
(74) *Attorney, Agent, or Firm*—John A. VanOphen

(57) ABSTRACT

A linkless variable valve mechanism includes a rocker arm having a first end and a second end. A rocker roller is carried by the first end of the rocker arm, and engages an input cam lobe disposed upon an input shaft. A frame member having a first end and a second end is pivotally mounted upon the input shaft. The first end of the frame member is pivotally coupled to a control shaft, and the second end is pivotally coupled to the second end of the rocker arm. An output cam is pivotally mounted upon the input shaft. An output cam follower is attached to the output cam, and includes an inside surface. A sliding block is pivotally coupled to the second end of the rocker arm and engages the inside surface of the cam follower.

19 Claims, 4 Drawing Sheets

LINKLESS VARIABLE VALVE ACTUATION MECHANISM

CROSS REFERENCE TO RELATED APPLICATIONS

This application claims the benefit of U.S Provisional Patent Application Ser. No. 60/176,977, filed Jan. 19, 2000.

TECHNICAL FIELD

This invention relates to variable valve actuation mechanisms for internal combustion engines.

BACKGROUND OF THE INVENTION

Conventional internal combustion engines utilize air throttling device and timing devices. The throttle device or valve is actuated by a driver depressing and/or releasing the gas pedal, and regulates the air flow to the intake valves. The engine intake valves are driven by the camshaft of the engine. The intake valves open and close at predetermined angles of camshaft rotation to allow the descending piston to draw air into the combustion chamber. The opening and closing angles of the valves and the amount of valve lift is fixed by the cam lobes of the camshaft. The valve lift profile (i.e., the curve of valve lift plotted relative to rotation of the camshaft) of a conventional engine is generally parabolic in shape.

Modern internal combustion engines may incorporate more complex and technologically advanced throttle control systems, such as, for example, an intake valve throttle control system. Intake valve throttle control systems, in general, control the flow of gas and air into and out of the cylinders of an engine by varying the valve lift timing, amount of lift and/or duration (i.e., the valve lift profile) of the intake valves in response to engine operating parameters, such as, for example, engine load, speed, and driver input. Intake valve throttle control systems vary the valve lift profile through the use of various mechanical and/or electromechanical configurations, generally referred to herein as variable valve actuating (VVA) mechanisms. One example of a VVA mechanism is detailed in commonly-assigned U.S. Pat. No. 5,937,809, the disclosure of which is incorporated herein by reference.

Conventional VVA mechanisms generally include a link which connects the input rocker arm of the mechanism with the output cam of the mechanism. The use of a link increases the size of the VVA mechanism, and thus a larger space is required in order to install the VVA mechanism within the engine. The link is typically coupled to the input rocker arm and the output cam with joints and/or pins. Thus, the use of a link requires additional component parts and thereby makes the VVA mechanism relatively complex from a mechanical standpoint. The many component parts increase the cost of the mechanism and make the mechanism more difficult to assemble and manufacture. The joints and pins of a conventional VVA mechanism are subject to interfacial frictional forces which negatively impact durability and efficiency. The link adds to the oscillatory mass of the VVA mechanism, and thereby limits the effective engine operating range within which the VVA mechanism can be used.

Therefore, what is needed in the art is a VVA mechanism having fewer component parts, thereby reducing cost and complexity of the mechanism.

Furthermore, what is needed in the art is a VVA mechanism with fewer joints and/or pins, thereby reducing interfacial frictional losses and increasing the durability of the mechanism.

Even further, what is needed in the art is a VVA mechanism having reduced package size.

Still further, what is needed in the art is a VVA mechanism having a reduced oscillating mass to thereby enable the mechanism to operate across a wider range of engine operating conditions.

Moreover, what is needed in the art is a VVA mechanism that eliminates the link, thereby reducing the overall size, reducing interfacial frictional losses, and reducing the oscillating mass of the mechanism.

SUMMARY OF THE INVENTION

The present invention provides a linkless variable valve mechanism for varying the valve lift profile of one or more associated valves of an internal combustion engine.

The invention comprises, in one form thereof, a rocker arm having a first end and a second end. A rocker roller is carried by said first end and engages an input cam lobe disposed upon an input shaft. A frame member having a first end and a second end is pivotally mounted upon the input shaft. The first end of the frame member is pivotally coupled to a control shaft, and the second end is pivotally coupled to the second end of the rocker arm. An output cam is pivotally mounted upon the input shaft. An output cam follower is attached to the output cam, and includes an inside surface. A sliding block is pivotally coupled to the second end of the rocker arm and engages the inside surface of the cam follower.

An advantage of the present invention is that the link member found in conventional variable valve mechanisms is eliminated, thus reducing the oscillating mass of the mechanism, reducing lash spring loads, and increasing the operating speed range of the mechanism.

A further advantage of the present invention is that the mechanism occupies less space than a conventional, link-actuated variable valve actuating mechanism.

A still further advantage of the present invention is that the pin joint used to couple the link to the output cam in a conventional variable valve actuating mechanism is eliminated, thereby reducing the number of component parts, the mechanical complexity, and the interfacial frictional losses.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DESCRIPTION OF THE PREFERRED EMBODIMENTS

Figure 1:
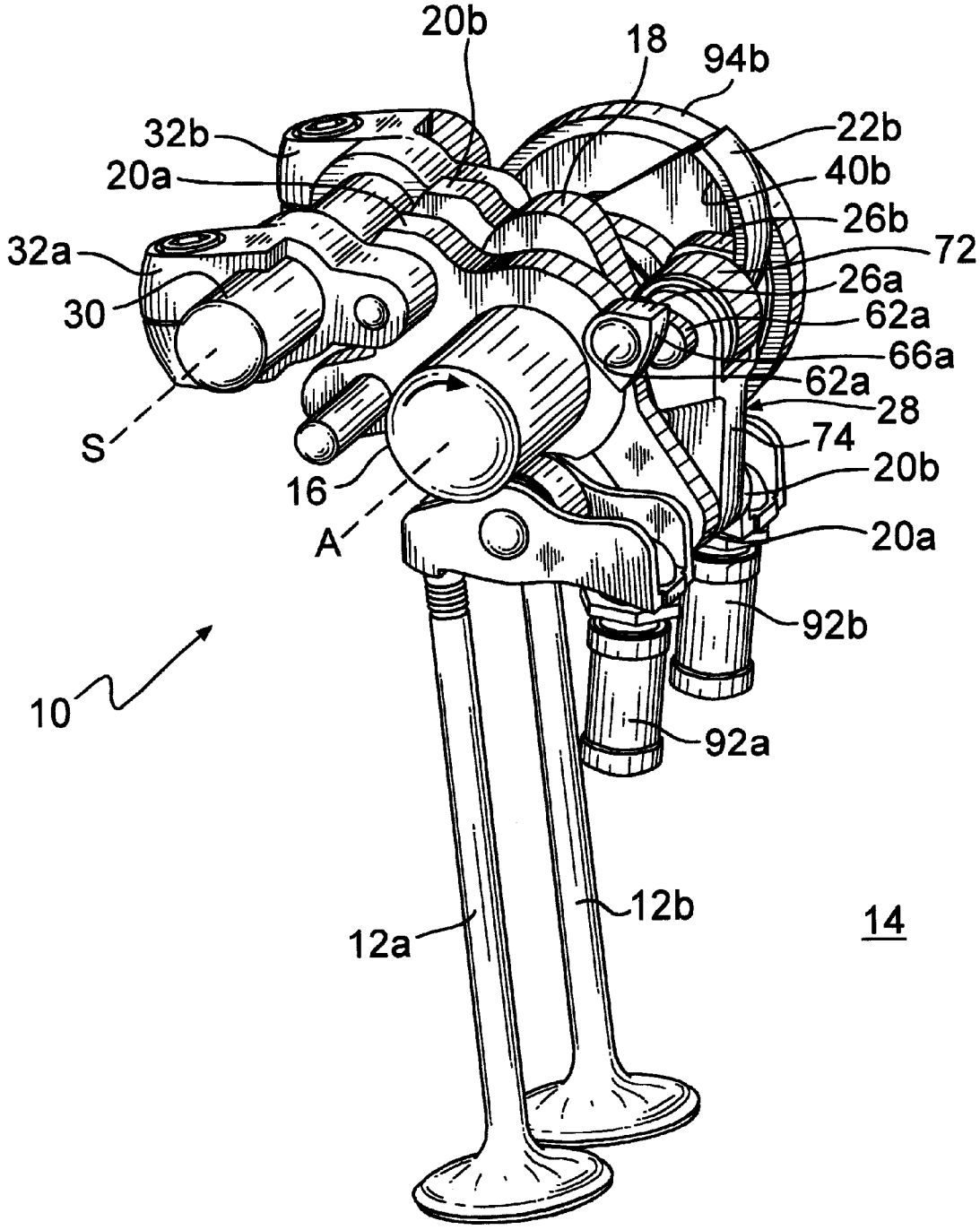
FIG. 1 is an isometric view of one embodiment of a linkless VVA mechanism of the present invention.
Figure 2:
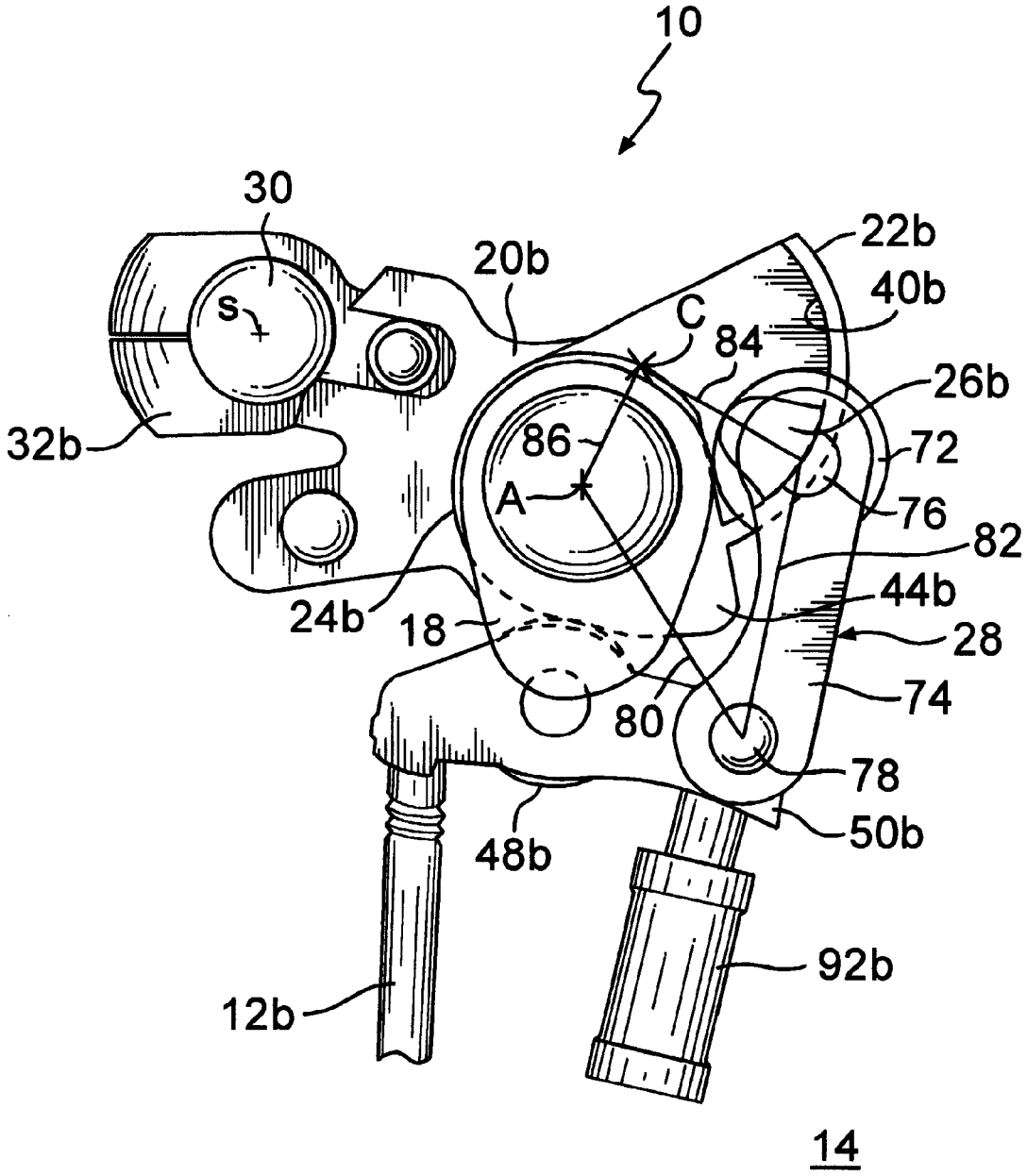
FIG. 2 is an end view of the linkless VVA mechanism of FIG. 1, having certain elements removed for the sake of clarity.

Referring now to the drawings, and particularly to FIGS. 1 and 2, there is shown one embodiment of a linkless variable valve actuating (LVVA) mechanism of the present invention. It should be noted that certain components are omitted from the several views for the sake of clarity. Generally, and as will be described with more particularity hereinafter, LVVA mechanism 10 selectively varies the duration and lift of dual inlet valves 12*a,* 12*b* of an associated cylinder (not shown) of engine 14. LVVA 10 is installed in operable relation with rotary input shaft 16, having an input cam lobe 18. LVVA mechanism 10 includes frame members 20*a,* 20*b,* output cam followers 22*a,* 22*b* (only one shown), output cams 24*a,* 24*b* (FIG. 2, only one shown), sliding blocks 26*a,* 26*b* and rocker assembly 28.

Rotary input shaft 16 is an elongate shaft member, such as, for example, a camshaft of engine 14. Input shaft 16 has central axis A, and is rotated three-hundred and sixty degrees (360 degrees) around central axis A. Input shaft 16 is driven to rotate in timed relation to the engine crankshaft (not shown), such as, for example, by a camshaft drive, chain, or other suitable means. Input shaft 16 extends the length of the cylinder head (not shown) of multi-cylinder engine 14. A single LVVA mechanism 10 is associated with each cylinder of engine 14. Input shaft 16 includes input cam lobe 18, which rotates as substantially one body with input shaft 16. Input cam lobe 18 is, for example, affixed to or integral with input shaft 16.

Frame members 20*a,* 20*b* are pivotally mounted upon input shaft 16, each disposed on a respective side of and generally adjacent to input cam lobe 18. Frame members 20*a,* 20*b* are each pivotally coupled at a first end thereof (not referenced) to a respective side of a first end (not referenced) of rocker assembly 28. Frame members 20*a,* 20*b* are each pivotally coupled at a second end thereof (not referenced) to control shaft 30 by respective shaft couplers 32*a,* 32*b,* such as, for example, shaft clamps. Frame members 20*a,* 20*b* are not rotated relative to central axis A by the rotation of input shaft 16. Rather, frame members 20*a,* 20*b* are each pivoted relative to central axis A by the operation of control shaft 30. As will be more particularly described hereinafter, the pivoting of frame members 20*a,* 20*b* relative to central axis A establishes the angular position of rocker arm assembly 28 relative to central axis A which, in turn, establishes the angular position of output cams 24*a,* 24*b* relative to central axis A to thereby vary the valve lift profile.

Output cam followers 22*a,* 22*b* (only one shown) are pivotally mounted upon input shaft 16. More particularly, output cam follower 22*a* is disposed generally adjacent frame member 20*a* such that frame member 20*a* is intermediate output cam follower 22*a* and input cam lobe 18, and output cam follower 22*b* is disposed generally adjacent frame member 20*b* such that frame member 20*b* is intermediate output cam follower 22*b* and input cam lobe 18. For the sake of clarity, and in order to reveal other components of LVVA 10, only output cam follower 22*b* is illustrated. Output cam followers 22*a,* 22*b* each have a respective semi-circular inside surface 40*a,* 40*b*. Each inside surface 40*a,* 40*b* has a constant radius and a common centerline C (FIG. 2). Centerline C is disposed a predetermined distance from and is substantially parallel relative to central axis A of input shaft 16. Output cam followers 22*a,* 22*b* are not rotated by the rotation of input shaft 16. Rather, and as will be more particularly described hereinafter, output cam followers 22*a,* 22*b* are each oscillated through a predetermined angular range, such as, for example, forty-five degrees, relative to centerline C. Output cam followers 22*a,* 22*b* are attached to or integral with output cams 24*a,* 24*b* (only one of which is shown), respectively.

Output cams 24*a,* 24*b* (only one shown) are each pivotally mounted upon input shaft 16 and are substantially concentric with central axis A thereof. Output cams 24*a,* 24*b* are not rotated by input shaft 16, but are rather oscillated as substantially one body with a respective one of output cam followers 22*a,* 22*b* through a predetermined angular range, such as, for example, forty-five degrees. For the sake of clarity, and in order to reveal other components of LVVA 10, only output cam 24*b* is illustrated (FIG. 2). Each of output cams 24*a,* 24*b* include a respective output cam lobe 44*a,* 44*b* (only one shown) having a predetermined lift profile. Output cams 24*a,* 24*b* engage a respective roller finger follower roller 48*a,* 48*b* (only one shown) of a conventional roller finger follower (RFF) 50*a,* 50*b*. The portion of the lift profile of output cams 24*a,* 24*b* which engage RFF rollers 48*a,* 48*b,* respectively, determines the valve lift profile of a corresponding valve 12*a,* 12*b*.

Sliding blocks 26*a,* 26*b* are coupled to rocker assembly 28. More particularly, each of sliding blocks 26*a,* 26*b* are pivotally coupled by respective block couplers 62*a,* 62*b* (FIG. 1, only one shown), such as, for example, pins, to the end (not referenced) of rocker assembly 28 opposite the end thereof which is pivotally coupled to frame members 20*a,* 20*b*. Sliding block 26*a* is pivotally coupled by coupler 62*a* to the side of rocker assembly 28 that is adjacent output cam follower 22*a,* and sliding block 26*b* is pivotally coupled by coupler 62*b* (not shown) to the side of rocker assembly 28 that is adjacent output cam follower 22*b*. Sliding blocks 26*a,* 26*b* each include a respective face 66*a,* 66*b* (only one shown) that is disposed in sliding engagement with a respective inside surface 40*a,* 40*b* of output cam followers 22*a,* 22*b,* respectively. Faces 66*a,* 66*b* are surfaces having a predetermined radius that is substantially equal to the radius of a corresponding constant-radius inside surface 40*a,* 40*b* of output cam followers 22*a,* 22*b,* respectively.

Rocker assembly 28 includes rocker roller 72 and rocker arm 74. Rocker roller 72 is pivotally coupled to one end (not referenced) of rocker arm 74 by roller coupler 76 (FIG. 2), such as, for example, a pin. Rocker roller 72 engages input cam lobe 18, and is carried by rocker arm 74. As input cam lobe 18 rotates in conjunction with input shaft 16, rocker arm 74 is displaced toward and away from input shaft 16 in a generally-radial direction relative to central axis A thereof. Rocker arm 74, at the end thereof that is opposite rocker roller 72, is pivotally coupled to each of frame members 20*a,* 20*b* by rocker arm coupler 78 (FIG. 2), such as, for example, a pin.

Control shaft 30 is selectively rotated, such as, for example, by an actuator subassembly (not shown) to establish the valve lift profile, as will be more particularly described hereinafter. Control shaft 30 rotates about shaft axis S, which is substantially parallel with and spaced apart from central axis A of input shaft 16. Control shaft 30 is coupled to each of frame members 20*a,* 20*b* by respective shaft couplers 32*a,* 32*b,* such as, for example, shaft clamps.

In use, input shaft 16 is rotated in timed relation to the crankshaft (not shown), such as, for example, by a camshaft drive, chain, or other suitable means, of engine 14. Rotation of input shaft 16 results in the rotation of input cam lobe 18, which is integral with or affixed to input shaft 16. Input cam lobe 18 engages rocker roller 72 which is carried by rocker arm 74. As input cam lobe 18 rotates, the lift profile of input cam lobe 18 engages rocker roller 72 and thereby displaces rocker arm 74 toward and away from input shaft 16 in a generally-radial direction relative to central axis A thereof. Sliding blocks 26*a,* 26*b* are coupled to and carried by rocker arm 74 as described above. Thus, the generally-radial displacement of rocker arm 74, in turn, displaces sliding blocks 26*a,* 26*b* toward and away from input shaft 16 in a generally-radial direction relative to central axis A. Sliding blocks 26*a,* 26*b* engage a corresponding inside surface 40*a,* 40*b* of output cam followers 22*a,* 22*b,* respectively.

The generally-radial displacement of sliding blocks 26*a,* 26*b* toward and away from input shaft 16, in turn, pivot the corresponding output cam followers 22*a,* 22*b* relative to central axis A. Thus, sliding blocks 26*a,* 26*b* act through centerline C, which is a predetermined distance from and is substantially parallel relative to central axis A of input shaft 16. Since centerline C of output cam followers 22*a,* 22*b* is spaced from central axis A of input shaft 16, output cams 24*a,* 24*b* oscillate relative to central axis A as if being pulled by a phantom link or bar connecting rocker arm 74 and inside surfaces 40*a,* 40*b* of output cam followers 22*a,* 22*b,* respectively.

The foregoing discussion, and the superior kinematics of LVVA mechanism 10 relative to a conventional link-actuated mechanism, are best illustrated with reference to FIG. 2, which illustrates the aforementioned phantom link or bar connecting rocker arm 74 with inside surfaces 40*a,* 40*b*. LVVA mechanism 10, for purposes of illustration of the operation and kinematics thereof, includes four bars, one of which produces the effect of a link within LVVA 10 without the presence of an actual link member.

Frame bar 80 is represented by a line drawn from rocker arm coupler 78 to central axis A of input shaft 16. Frame bar 80 is grounded, i.e., it is stationary and does not move except during rotation of control shaft 30 to establish a desired valve lift profile. Rocker bar 82 is represented by a line drawn from rocker arm coupler 78 to the centerline (not referenced) of roller coupler 76. Rocker bar 82 oscillates with rocker arm 74 as input cam lobe 18 rotates. The oscillation of rocker arm 74, and rocker bar 82, in turn, results in the oscillation of sliding blocks 26*a,* 26*b*. The oscillation of sliding blocks 26*a,* 26*b,* in turn, oscillate output cam followers 22*a,* 22*b* and, thus, output cams 24*a,* 24*b* attached thereto or integral therewith. Sliding blocks 26*a,* 26*b* oscillate output cam followers 22*a,* 22*b* relative to centerline C thereof. Since centerline C is not coincident with central axis A of input shaft 16, about which output cams 24*a,* 24*b* oscillate, but rather is spaced from and substantially parallel relative to central axis A, sliding blocks 26*a,* 26*b* act upon output cam followers 22*a,* 22*b* through link bar 84. Link bar 84 is represented by a line drawn from roller coupler 76 to centerline C. Output cam followers 22*a,* 22*b* are acted upon by sliding blocks 26*a,* 26*b* as if link bar 84 were an actual, physical link member connecting rocker arm 74 with output cam followers 22*a,* 22*b*. Although link bar 84 acts as an actual, physical link member, and output cams 24*a,* 24*b* oscillate as though connected to rocker arm 74 by a conventional link member, LVAA mechanism 10 includes no physical link member. Thus, LVVA mechanism 10 is not subject to the geometric constraints to which a conventional link-actuated VVA mechanism is subjected. Therefore, substantial savings in oscillating mass, package size, and kinematics are obtained. Output cam bar 86 is the fourth bar, and is represented by a line drawn from central axis A to centerline C.

The valve lift profile of valves 12*a,* 12*b* is selectively established, and varied, dependent at least in part upon the angular position of control shaft 30 relative to central shaft axis S thereof. As described above, frame members 20*a,* 20*b* are pivotally coupled to control shaft 30. Pivoting of control shaft 30 relative to central axis S thereof, in turn, pivots frame members 20*a,* 20*b* relative to central axis A of input shaft 16. Thus, the angular position of control shaft 30 relative to central shaft axis S thereof, in turn, establishes the angular position of frame members 20*a,* 20*b* relative to central axis A of input shaft 16. As described above, frame members 20*a,* 20*b* are pivotally coupled to rocker arm 74 which, in turn, is coupled to sliding blocks 26*a,* 26*b* and, thus, to output cam followers 22*a,* 22*b* which are attached to or integral with output cams 24*a,* 24*b* respectively. Thus, the angular position of frame members 20*a,* 20*b* relative to central axis A, in turn, establishes the angular position of output cams 24*a,* 24*b* relative to central axis A.

The angular position of output cams 24*a,* 24*b,* in turn, establish the angular position of output cam lobes 44*a,* 44*b* relative to central axis A and thus the angular proximity thereof to RFF rollers 48*a,* 48*b,* respectively. The angular proximity of output cam lobes 44*a,* 44*b* relative to RFF rollers 48*a,* 48*b,* respectively, determine which portion of the lift profile of output cam lobes 44*a,* 44*b* that engage RFF rollers 48*a,* 48*b,* respectively, as output cam lobes 44*a,* 44*b* are oscillated. Engagement of RFF rollers 48*a,* 48*b* by oscillating output cam lobes 44*a,* 44*b,* respectively, pivot RFFs 50*a,* 50*b,* respectively, about corresponding lash adjusters 92*a,* 92*b* and thereby actuate valves 12*a,* 12*b*.

For example, in order to lift valves 12*a,* 12*b* a substantial amount, the lift profile or peak of output cam lobes 44*a,* 44*b* are placed in close angular/rotational proximity to RFF rollers 48*a,* 48*b,* respectively. Thus, as output cams 24*a,* 24*b* are oscillated a substantial portion of the lift profile of output cam lobes 44*a,* 44*b* engage a corresponding RFF roller 48*a,* 48*b* and impart a corresponding relatively high amount of lift to valves 12*a,* 12*b*. Conversely, and as a further example, in order to minimally actuate valves 12*a,* 12*b,* the lift profile or peak of output cam lobes 44*a,* 44*b* are placed in relatively distant angular/rotational proximity to RFF rollers 48*a,* 48*b*. Thus, as output cams 24*a,* 24*b* are oscillated a relatively small portion of the lift profile of output cam lobes 44*a,* 44*b,* or only the zero-lift profile thereof, engage a corresponding RFF roller 48*a,* 48*b* and impart only a slight or no lift to valves 12*a,* 12*b*.

It should be particularly noted that block couplers 62*a,* 62*b,* which pivotally couple sliding blocks 26*a,* 26*b,* respectively, to rocker arm 74 replaces the conventional pin joint found in conventional VVA mechanisms which connects the link member with output cam. In order to lubricate a pin joint, lubricant must be disposed at the interface of the pin and the joint. Typically, there is minimal clearance at the interface and it is difficult to ensure lubricate is disposed and remains within the interface. In contrast, faces 66*a,* 66*b* of sliding blocks 26*a,* 26*b* have relatively substantial areas and are thus more easily lubricated relative to a conventional pin joint. Thus, sliding blocks 26*a,* 26*b* reduce friction, wear and tear, and heat build up, thereby increasing the operating life of LVVA mechanism 10, relative to a conventional VVA mechanism having a conventional pin joint.

LVVA mechanism 10 includes spiral lash springs 94*a,* 94*b* (FIG. 1, only one shown). It should also be particularly noted that the spring requirements, such as, for example, spring force, size and diameter of lash springs 94*a,* 94*b* are substantially reduced due to the elimination of a physical link member which reduces the oscillating mass of LVVA mechanism 10 relative to conventional VVA mechanisms.

Figure 3:
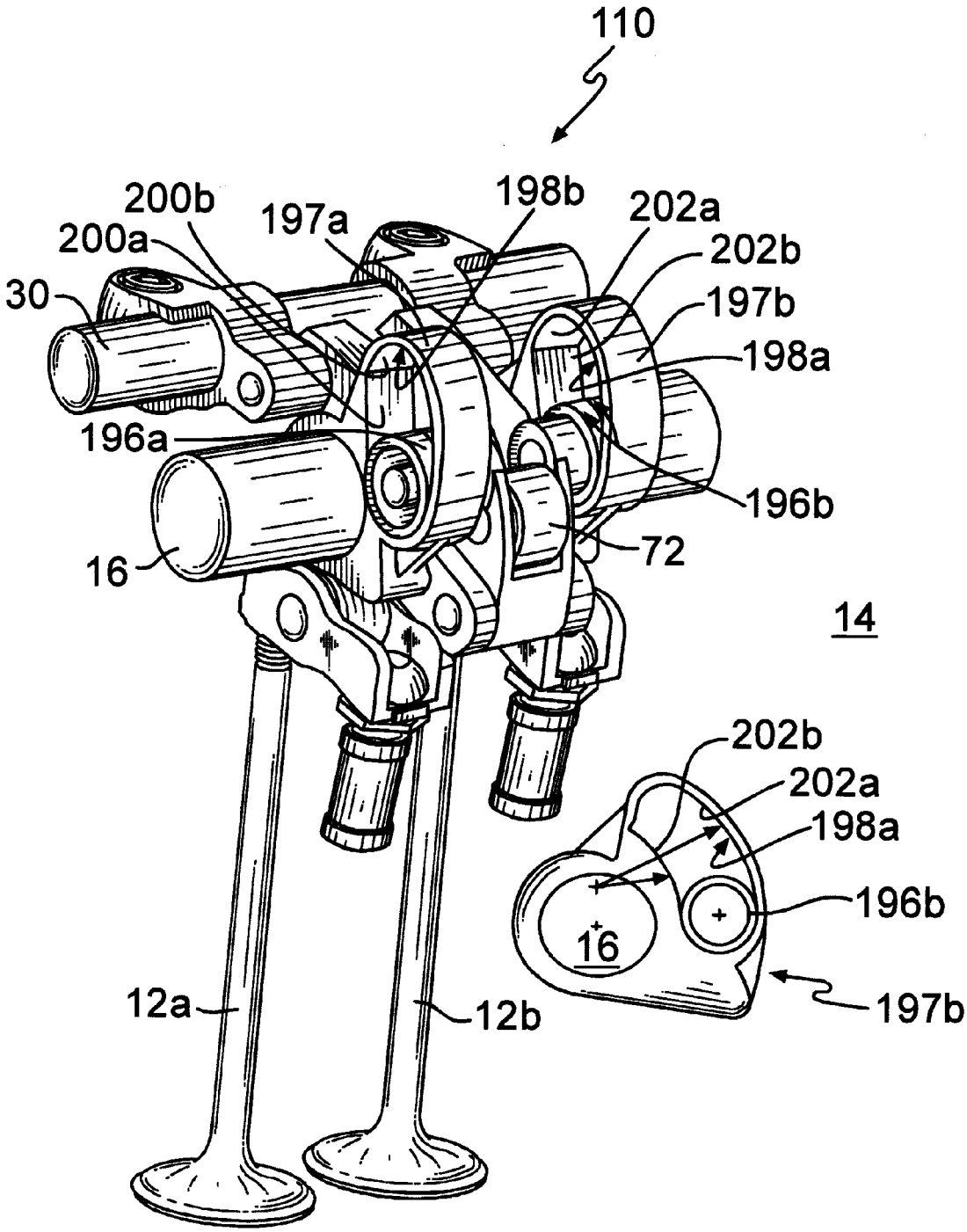
FIG. 3 is an isometric view of a second embodiment of a linkless VVA mechanism of the present invention.
Figure 4:
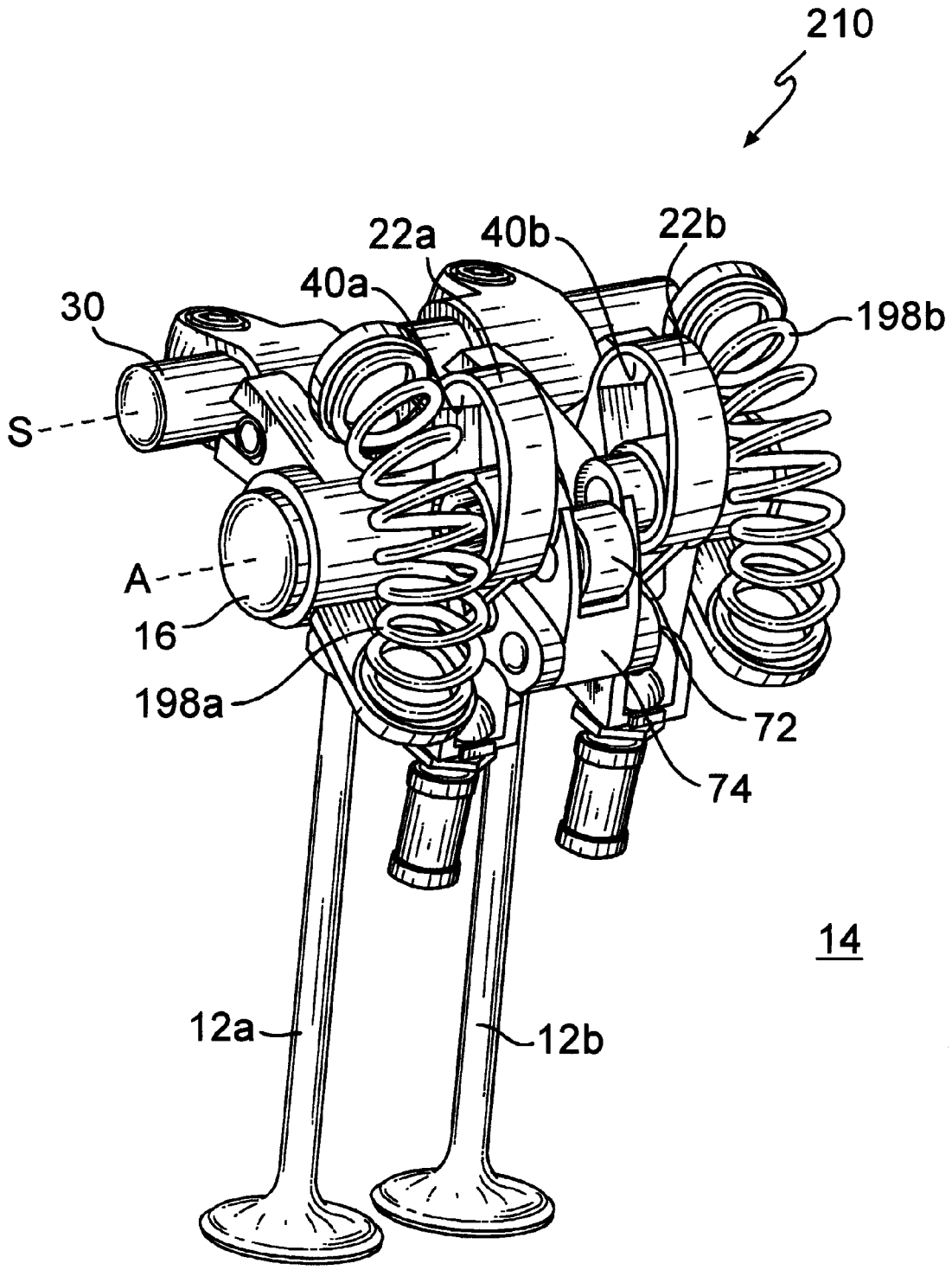
FIG. 4 is an isometric view of the linkless VVA mechanism of FIG. 3 having bent helical springs.

Referring now to FIGS. 3 and 4, a second and third embodiment of LVVAs of the present invention are shown.

The same reference numbers used to identify component parts of LVVA 10 are also used to refer to identical component parts of the second and third embodiments. Referring specifically to FIG. 3, LVVA mechanism 110 replaces sliding blocks 26*a,* 26*b* of LVVA mechanism 10 with split rollers 196*a,* 196*b*. Further, LVVA mechanism 110 has alternately configured output cam followers 197*a,* 197*b*. Split rollers 196*a,* 196*b* engage the inside surface 198*a,* 198*b* of a respective output cam follower 197*a,* 197*b*. Each of inside surfaces 198*a,* 198*b* are configured as a "closed loop" surface and include contoured sections 200*a,* 200*b* and 202*a,* 202*b,* respectively. The contoured inside surfaces 198*a,* 198*b* and the "closed-loop" configuration thereof enable split rollers 196*a,* 196*b* of LVVA mechanism 110 to perform both clockwise and counter-clockwise rotation of output cams 24*a,* 24*b*. Thus, split rollers 196*a,* 196*b,* in conjunction with output cam followers 197*a,* 197*b,* return output cams 24*a,* 24*b* to a zero or no lift position without the need for lash springs. Further, the use of sliding rollers 196*a,* 196*b* reduces friction relative to sliding blocks 26*a,* 26*b* of LVVA mechanism 10. Referring specifically to FIG. 4, LVVA mechanism 210 is substantially similar to LVVA mechanism 110, with the addition of bent helical coil springs 294*a,* 294*b* for lash compensation.

In the embodiment shown, a single LVVA 10 is associated with one cylinder (not shown) of engine 14. However, it is to be understood that multiple LVVA mechanisms of the present invention can be associated with each cylinder of an engine.

In the embodiment shown, frame members 20*a,* 20*b* are described as being mounted upon input shaft 16. However, it is to be understood that the frame members may be alternately mounted, such as, for example, to a secondary shaft or other structure while still being configured for pivotal movement relative to the input shaft.

In the embodiment shown, the operation and kinematic advantages of LVVA 10 are illustrated, in part, by rocker bar 82 and link bar 84. As shown in FIG. 2, rocker bar 82 and link bar 84 intersect at a point that is generally concentric relative to roller coupler 76. However, it is to be understood that the LVVA mechanism of the present invention can be alternately configured, such as, for example, with varying link bar and rocker bar configurations but with the same kinematic characteristics and advantages.

In the embodiment shown, LVVA 10 includes two frame member 20*a,* 20*b,* two output cam followers 22*a,* 22*b,* and two output cams 24*a,* 24*b,* to thereby actuate dual inlet valves of a corresponding engine cylinder. However, it is to be understood that LVVA 10 can be alternately configured, such as, for example, for use with a cylinder having only one inlet valve. In this embodiment, the LVVA would include a single frame member, one output cam follower and one output cam.

In the embodiment shown, LVVA 10 is described as being for use with an internal combustion engine. However, it is to be understood that LVVA mechanism 10 can be alternately configured, such as, for example, for use with various other mechanisms or machinery which require may advantageously utilize variable displacement, duration and/or timing of one or more moving components.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed:

1. A linkless variable valve mechanism, comprising:

a rocker arm having a first end and a second end, a rocker roller carried by said first end and configured for engaging an input cam lobe disposed upon an input shaft;

at least one frame member configured for being pivotally mounted upon the input shaft, said at least one frame member having a first end and a second end, said first end configured for being pivotally coupled to a control shaft, said second end being pivotally coupled to said second end of said rocker arm;

at least one output cam configured for being pivotally mounted upon the input shaft;

at least one output cam follower, each of said at least one output cam follower being attached to a corresponding one of said at least one output cam, each of said at least one output cam follower having an inside surface; and at least one sliding block pivotally coupled to said second end of said rocker arm and engaging said inside surface of a corresponding one of said at least one output cam follower.

2. The linkless variable valve mechanism of claim 1, wherein said at least one output cam follower is integral and monolithic with said at least one output cam.

3. The linkless variable valve mechanism of claim 1, wherein said inside surface of each of said at least one output cam follower has a constant radius, said constant radius having a centerline.

4. The linkless variable valve mechanism of claim 3, wherein said centerline is spaced from and substantially parallel relative to a central axis of the input shaft.

5. The linkless variable valve mechanism of claim 3, wherein each of said at least one sliding block includes a face, at least a portion of said face engaging said inside surface of said output cam follower, said face having a face radius being substantially equal to said constant radius of said inside surface of said output cam follower.

6. The linkless variable valve mechanism of claim 1, wherein:

said at least one frame member comprises a first frame member and a second frame member, said first frame member configured for being pivotally mounted to the input shaft on a first side of said input cam lobe, said second frame member configured for being pivotally mounted to the input shaft on a second side of said input cam lobe;

said at least one output cam comprises a first output cam and a second output cam, said first output cam configured for being pivotally mounted to the input shaft on said first side of said input cam lobe, said second output cam lobe configured for being pivotally mounted to the input shaft on said second side of said input cam lobe; and said at least one sliding block comprises a first sliding block and a second sliding block, said first sliding block being pivotally coupled to said rocker arm on a first side thereof, said second sliding block being pivotally coupled to said rocker arm on a second side thereof, each of said first sliding block and said second sliding block engaging a respective said inside surface of a corresponding one of said first and said second output cam followers.

7. The linkless variable valve mechanism of claim 1, wherein said at least one sliding block comprises a roller.

8. The linkless variable valve mechanism of claim 1, further comprising lash springs.

9. The linkless variable valve mechanism of claim 8, wherein said lash springs comprise one of spiral springs and bent helical springs.

10. A linkless variable valve mechanism, comprising:

an elongate input shaft having a central axis, an input cam lobe disposed on said input shaft;

a rocker arm having a first end and a second end, a rocker roller carried by said first end and engaging said input cam lobe;

at least one frame member pivotally mounted upon said input shaft, said at least one frame member having a first end and a second end, said second end being pivotally coupled to said second end of said rocker arm;

at least one output cam pivotally mounted upon said input shaft;

at least one output cam follower, each of said at least one output cam follower being attached to a corresponding one of said at least one output cam, each of said at least one output cam follower having an inside surface; and at least one sliding block pivotally coupled to said second end of said rocker arm and engaging said inside surface of a corresponding one of said at least one output cam follower.

11. The linkless variable valve mechanism of claim 10, further comprising a control shaft, said first end of each of said at least one frame member being pivotally coupled to said control shaft.

12. The linkless variable valve mechanism of claim 10, wherein said at least one output cam follower is integral and monolithic with said at least one output cam.

13. The linkless variable valve mechanism of claim 11, wherein said inside surface of each of said at least one output cam follower has a constant radius, said constant radius having a centerline.

14. The linkless variable valve mechanism of claim 13, wherein said centerline is spaced from and substantially parallel relative to said central axis of said input shaft.

15. The linkless variable valve mechanism of claim 13, wherein each of said at least one sliding block includes a face, at least a portion of said face engaging said inside surface of said output cam follower, said face having a face radius being substantially equal to said constant radius of said inside surface of said output cam follower.

16. The linkless variable valve mechanism of claim 10, wherein said at least one sliding block comprises a roller.

17. The linkless variable valve mechanism of claim 11, further comprising lash springs.

18. The linkless variable valve mechanism of claim 17, wherein said lash springs comprise one of spiral springs and bent helical coil springs.

19. An internal combustion engine having a linkless variable valve mechanism, comprising:

an elongate input shaft having a central axis, an input cam lobe disposed on said input shaft;

a rocker arm having a first end and a second end, a rocker roller carried by said first end and engaging said input cam lobe;

at least one frame member pivotally mounted upon said input shaft, said at least one frame member having a first end and a second end, said second end being pivotally coupled to said second end of said rocker arm;

at least one output cam pivotally mounted upon said input shaft;

at least one output cam follower, each of said at least one output cam follower being attached to a corresponding one of said at least one output cam, each of said at least one output cam follower having an inside surface; and at least one sliding block pivotally coupled to said second end of said rocker arm and engaging said inside surface of a corresponding one of said at least one output cam follower.

* * * * *